US011273958B2

(12) United States Patent
Bowman

(10) Patent No.: US 11,273,958 B2
(45) Date of Patent: Mar. 15, 2022

(54) GIFT BAG HAVING A THREE-DIMENSIONAL WINDOW DISPLAY AND FIXED THREE-DIMENSIONAL ELEMENTS

(71) Applicant: The Lindy Bowman Company, Elkridge, MD (US)

(72) Inventor: Linden H Bowman, Chatham, NJ (US)

(73) Assignee: The Lindy Bowman Company, Elkridge, MD (US)

( * ) Notice: Subject to any disclaimer, the term of this patent is extended or adjusted under 35 U.S.C. 154(b) by 321 days.

(21) Appl. No.: 16/745,518

(22) Filed: Jan. 17, 2020

(65) Prior Publication Data

US 2021/0221569 A1 Jul. 22, 2021

(51) Int. Cl.

| | |
|---|---|
| ***B65D 33/04*** | (2006.01) |
| ***B65D 33/00*** | (2006.01) |
| ***B65D 33/12*** | (2006.01) |
| *B65D 30/20* | (2006.01) |

(52) U.S. Cl.

CPC ..... *B65D 33/004* (2013.01); *B65D 33/12* (2013.01); *B65D 31/10* (2013.01); *B65D 2203/00* (2013.01)

(58) Field of Classification Search

CPC .. B65D 33/12; B65D 33/004; B65D 2203/00; B65D 31/10

USPC ..... 206/769, 771; 40/124.06–124.8; 229/116.1, 162.1; 383/106

See application file for complete search history.

(56) References Cited

U.S. PATENT DOCUMENTS

| | | | | |
|---|---|---|---|---|
| 1,499,891 | A * | 7/1924 | Storer | G09F 1/06 40/124.08 |
| 2,314,721 | A * | 3/1943 | Lowenstein | A63J 13/00 428/13 |
| 2,748,527 | A * | 6/1956 | Seals | A63H 33/00 446/71 |
| 4,784,314 | A * | 11/1988 | Penick | B65D 5/4258 206/457 |
| 4,991,980 | A | 2/1991 | Cohen et al. | |
| 5,303,487 | A | 4/1994 | Olson | |
| 5,613,312 | A * | 3/1997 | Crowell | A45C 13/08 206/457 |
| 5,822,897 | A | 10/1998 | Ertzan | |
| 6,209,924 | B1 | 4/2001 | Pyle et al. | |

(Continued)

FOREIGN PATENT DOCUMENTS

| | | |
|---|---|---|
| KR | 2020080010496 | 8/2008 |
| WO | 2008034104 A2 | 3/2008 |

OTHER PUBLICATIONS

ShadowboxGiftCardBag—Youtube—Aug. 2017 (Year: 2017).*

(Continued)

*Primary Examiner* — Nathan J Newhouse
*Assistant Examiner* — Nina K Attel
(74) *Attorney, Agent, or Firm* — Cahn & Samuels, LLP

(57) ABSTRACT

Disclosed herein is a gift bag having a fixed three-dimensional window display and fixed three-dimensional elements. The bag includes a front that is substantially flat and a back that is disposed at a spaced distance behind the front. The front includes an aperture and a window display sheet through which a background and foreground display can be viewed. The foreground display is disposed at a spaced distance in front of the background display and affixed so that the background and foreground display together form one cohesive decorative scene or image.

11 Claims, 3 Drawing Sheets

(56) References Cited

U.S. PATENT DOCUMENTS

| | | | | |
|---|---|---|---|---|
| 6,749,064 | B1 | 6/2004 | Alrey | |
| D494,853 | S * | 8/2004 | Chan | D9/704 |
| 7,322,134 | B2 | 1/2008 | Cheek et al. | |
| 7,503,563 | B2 | 3/2009 | Bowman | |
| 7,627,967 | B1 | 12/2009 | Torvik | |
| 9,592,933 | B1 | 3/2017 | Campbell | |
| 2009/0050505 | A1 | 2/2009 | Rubin | |
| 2009/0314677 | A1 | 12/2009 | Teggatz et al. | |

OTHER PUBLICATIONS

Inthewoods—Mar. 2016 (Year: 2016).*
ShadowBoxBag—youtube—Dec. 2013 (Year: 2013).*
English Abstract of KR2020080010496, Aug. 6, 2008.

* cited by examiner

GIFT BAG HAVING A THREE-DIMENSIONAL WINDOW DISPLAY AND FIXED THREE-DIMENSIONAL ELEMENTS

I. BACKGROUND OF THE INVENTION

Conventional gift articles, such as gift bags and gift cards, have many configurations for displaying visual effects. For example, it is known in the art to provide greeting cards having cutouts or windows in the front panel of the card to reveal one or more photographs, articles, or special effects such as pop-up objects, snow globes, or the like.

Existing gift articles that include three-dimensional elements have several deficiencies. Some gift articles, such as window display gift cards, lack depth and visual interest. Other gift articles, such as holiday snow globe gift bags and boxes, may have shapes which protrude or distort, making storage, packing, or shipping of such articles difficult. Further, background elements in such articles may not be viewable at certain angles, and foreground elements may fall or clump in non-preferred locations, such as in the corners of a window display. Further still, gift articles such as pop-up gift cards do not display three-dimensional visual effects until the card is open. Other gift articles containing three-dimensional elements may be costly to manufacture and thus less desirable to consumers, whom the cost is passed on to.

It would therefore be desirable to improve the depth, visual interest, and convenient of storage, packing, and shipping in three-dimensional gift bags using fixed aspects.

U.S. Pat. No. 4,991,980 to Cohen et al. discloses a bag with auxiliary pocket and viewing window having a front, back, side, and bottom panels and a compartment forming partition panel. The partition panel is secured to the front panel so as to define primary and auxiliary load-carrying compartments. The auxiliary compartment is formed by the front panel and partition panel. The front panel may be apertured and overlaid with a transparent film so as to form a window. The partition is adhered to the front panel so as to form a pocket in which the contents are position for viewing through the window.

U.S. Pat. No. 5,303,487 to Olson discloses a window display card having a single sheet of paper tri-folded and of a rectangular shape. The card further has a framing section with a centrally disposed window for viewing a display item. Two-sided pressure sensitive adhesive strips are provided for securing the display item and sealing to a backing section. The backing section is hingedly attached to the framing section sealing the item of display between the sections allowing visual display through the window.

U.S. Pat. No. 5,822,897 to Ertzan discloses a self-contained card, envelope and stand having a cover, all suitable for mailing as an all-in-one unit. When the unit is reversed upon itself and fastened, the unit becomes a stand exhibiting its content without the need of any additional elements.

U.S. Pat. No. 6,209,924 B1 to Pyle et al. discloses an aesthetically pleasing greeting card having a tri-folded frame and a light transmitting carrier with a scene printed on both sides of the front cover. The scene is described as consisting of a pleasing image positioned on a first outer side and the reverse of that image positioned on an inner side such that the images register one over the other to form a single image when viewed from either the outer or the inner side. The light transmitting is inserted and adhered between two substantially equal sized folded over sections with substantially equal sized cutouts therethrough.

U.S. Pat. No. 6,749,064 B1 discloses a bag with article display aperture and folded support surface formed in a front panel thereof for supporting and displaying various types of articles The bag is formed of a relatively stiff material and its front panel is provided with cuts and scored areas defining a tab that is folded to form a generally wedge-shaped support surface for supporting various articles behind the aperture.

U.S. Pat. No. 7,627,967 B1 to Torvik discloses a greeting card and display box assembled from folded sheet material. The container disclosed has a front shroud or cover which opens to reveal the gift object mounted on a background within a framed window. The front cover is attached at the bottom, rear of the container and folds over the top to form a cover of the window. The front cover opens and folds at the rear of the container to form a stand that holds the container upright to display the gift object.

II. SUMMARY OF THE INVENTION

It is an object of the present invention to provide a gift bag having a fixed three-dimensional display that enhances depth and visual interest.

It is another object of this invention to provide a gift bag having a three-dimensional display but is substantially flat front for convenient storage, packing, or shipping.

It is still another object of this invention to provide a gift bag having a background display and foreground display that together form at least one cohesive image.

The foregoing and other objects of this invention are achieved by providing a gift bag having a three-dimensional window display comprising at least one substantially flat front. The substantially flat front has an aperture. A window display sheet is substantially aligned with the aperture and is substantially transparent and substantially flat. A back panel is affixed to the window display sheet and has at least a front side and a back side. The back panel is substantially aligned with the aperture and is disposed a spaced distance behind the substantially flat front. The back panel contains a background display and a foreground display. The foreground display is fixedly attached to the background display and is disposed a spaced distance in front of said background display. The foreground display and the background display form at least one cohesive display.

In one embodiment of the present invention, the gift bag has an aperture that is substantially rectangular. In other embodiments, the gift bag has an aperture that is substantially circular, triangular, hexagonal, or any other geometric configuration providing a display window. In still another embodiment, the window display sheet of the gift bag is a clear, transparent plastic film. In other embodiments, the window display sheet of the gift bag window display sheet is tinted, colored and/or translucent.

In one embodiment, the foreground display is substantially flat. In another embodiment, the foreground display is three-dimensional. In an embodiment, the foreground display casts a shadow on the background display as a result of being disposed at a spaced distance in front of the background display. In another embodiment, the background display is substantially flat. In still another embodiment, the background display is three-dimensional.

In an embodiment, the background of the window display contains at least one background image including but not limited to a decorative scene, slogan, trademark, or other message. Similarly, in one embodiment, the foreground display contains at least one decorative object, slogan, trademark, or other message. Alternatively, the foreground display contains at least a portion of a decorative scene, decorative object, slogan, trademark, or other message. The foreground display is preferably mounted to the background display to stand off that display via an adhesive but may be attached by other means including hook-and-loop fasteners, pins, staples, or stitching. In an embodiment, the foreground and background display form at least one cohesive image including but not limited to a decorative scene, slogan, trademark, or other message.

In one embodiment, the back panel is affixed directly to the window display sheet. In another embodiment, the back panel is affixed to an intermediate material, including not but limited to a foam frame or foam board, which is affixed to the window display sheet. For example, a 3 mm ethylene-vinyl acetate (EVA) foam frame is sandwiched between the back panel and the window display sheet, being fixedly attached to the front side of the back panel as well as the back side of the window display sheet.

In one embodiment, the three-dimensional window display is a container which is capable of being filled with a substance, for example, confetti, glitter, liquid, or similar, or any combination thereof. The container comprises the substantially flat front having an aperture, the window display sheet aligned with the aperture, and the back panel having the front side, the back side as well as a top side, a bottom side, a left side, and a right side. The edges of the top side, bottom side, left side, and right side of the back panel are affixed to the back of the window display sheet such that the back panel is disposed at a spaced distance from the substantially flat front.

In one embodiment, the gift bag contains one three-dimensional window display. In another embodiment, the gift bag contains multiple three-dimensional window displays. The multiple three-dimensional window displays can be displayed on one substantially flat side or on multiple substantially flat sides.

For definitional purposes and as applicable, the term "substantially" as used herein means "reasonably close to: nearly, almost, about" or "significantly" or "considerably" and can connote either a term of approximation or a term of magnitude.

As used herein, the term "substantially flat" means a having an aspect ratio from approximately 1.0 to approximately 1.2, with the aspect ratio being defined as the ratio of a surface's width to height.

As used herein, the term "substantially aligned with" means having a size and position sufficient to at least cover the aperture.

As used herein, the term "substantially coextensive" means approximately forming at least one cohesive display.

As used herein, the term "transparent" or "clear" means the ability to visually perceive an item, word, or similar through a medium. More specifically, the term "substantially transparent" means the ability to visually perceive at least a significant portion of the foreground display and the background image through the window display sheet.

III. BRIEF DESCRIPTION OF THE DRAWING

IV. DETAILED DESCRIPTION OF THE EMBODIMENTS

Referring now to the figures, wherein like reference numbers denote like components, elements, or features through the various illustrated embodiments discussed in detail below, the invention is a gift bag including a container and a pair of handles. While specific implementations of the disclosed technology are discussed, it should be understood that this is done for illustration purposes only. A person skilled in the relevant art will recognize that other components and configurations may be used without departing from the spirit and scope of the invention.

Figure 1:
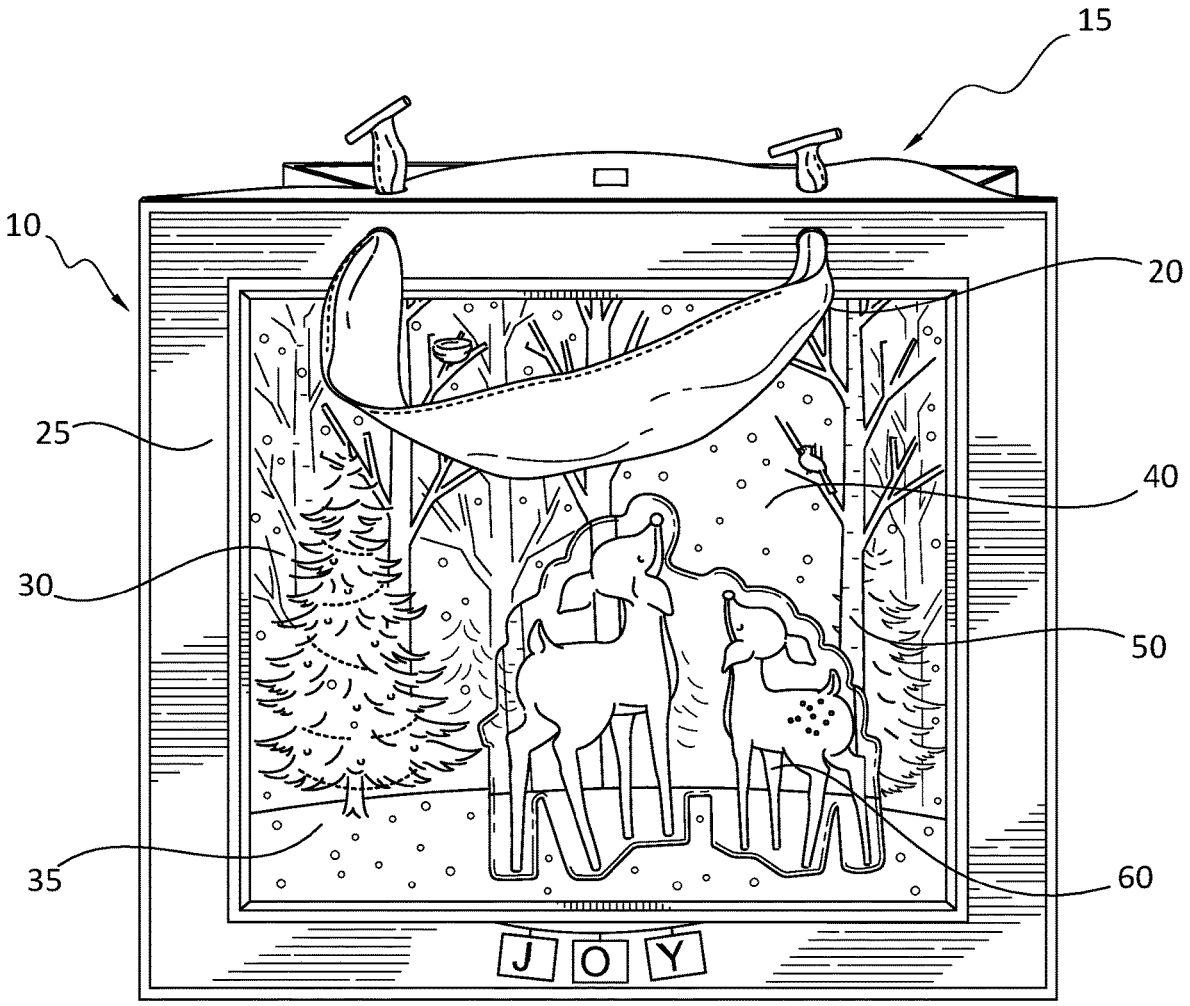
FIG. 1 is a front perspective view showing a gift bag having a three-dimensional window display and fixed three-dimensional elements.
Figure 2:
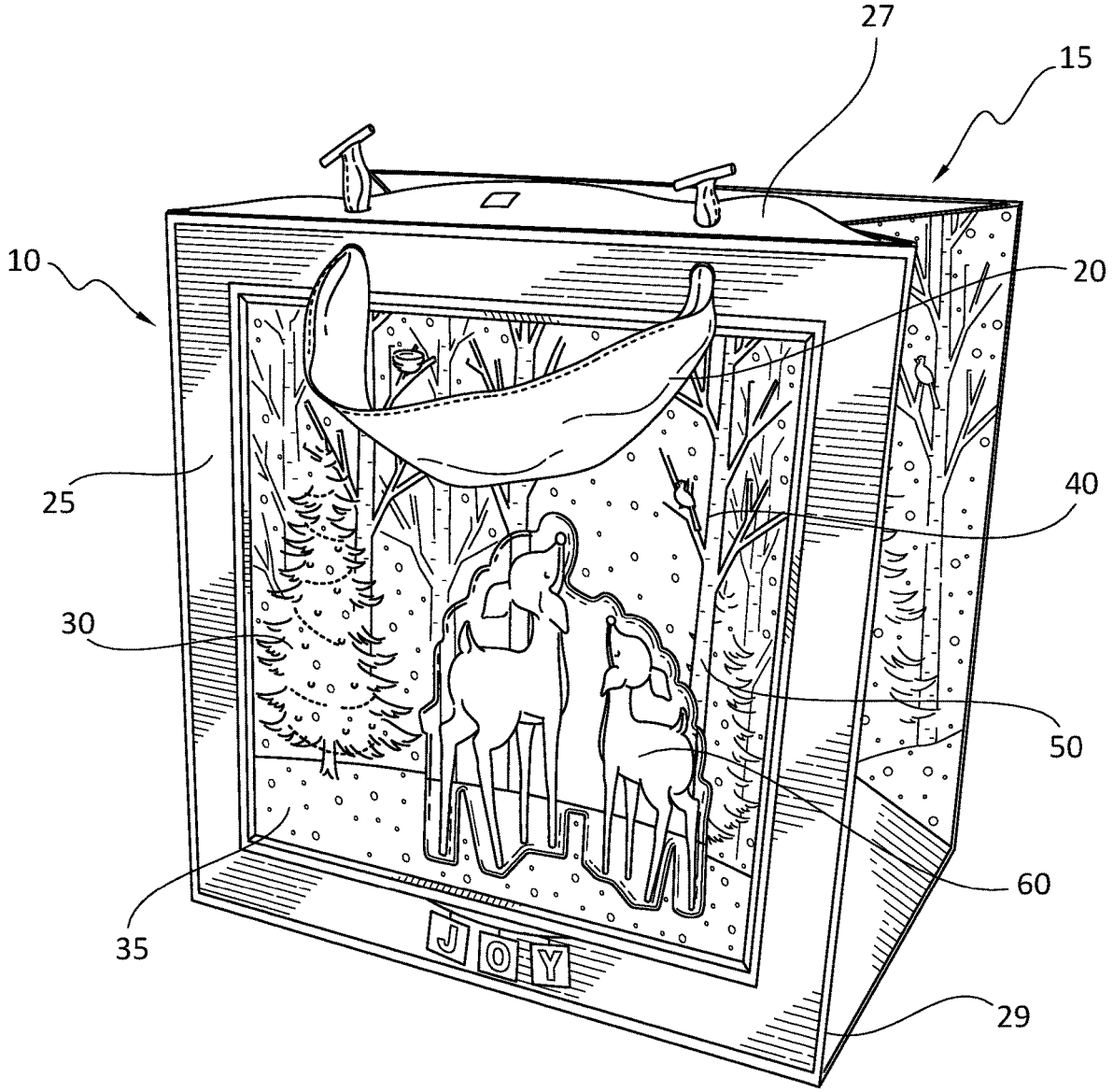
FIG. 2 is a front angled perspective view showing a gift bag having a three-dimensional window display and fixed three-dimensional elements.

FIGS. 1 and 2 illustrate a gift bag 10 in accordance with the present invention. Preferably, the bag 10 is composed of a conventional sheet-like bag-making material, recycled paper, or some biodegradable construct. The bag 10 is formed of a semi-rigid organic material. In another embodiment, however, the bag 10 is form from other materials of varying stiffness. The bag 10 has an open top end 15, a substantially flat front 25, a back 27, a bottom 29, which has a substantially rectangular aperture 30. A pair of recessable/retractable handles 20 that are ribbon-style or string-style with rigid or semi-rigid aglets exposed is secured to the upper end of the substantially flat front 25 and back 27 to prevent dislodgement of the handles, such as, for example, when the bag is bulky, heavy, or full, and/or to facilitate collapsible or compact storage, shipping, or display of the bag 10. In an embodiment, the handles 20 are formed from a flexible, organic or biodegradable material. In other embodiments, the handles 20 are formed from other materials of varying flexibility, for example, plastic, rubber, nylon and/or other types of fabric. In an embodiment, the aglets are exposed on the inside of the bag 10. In other embodiments, the aglets are exposed on the outside of the bag 10 or a combination of inside and outside of the bag 10. A window display sheet 35 is substantially aligned with the aperture 30. The window display sheet 35 is constructed of a substantially transparent or clear material and, in a preferred embodiment, is formed of a poly-vinyl chloride film or a clear biodegradable substitute. In other embodiments, the window display sheet 35 may be cloudy, stippled, flaked, beaded, patterned, holographic, rippled, glittered, sprinkled, bejeweled, layered, or contain any other ornamental feature or combination of ornamental features. In yet other variations, the window display sheet 35 may be tinted, colored, iridescent, matte, glossy, pearlescent, or any combination therein. The bag 10 further has a back panel 40 affixed to the window display sheet 35 and substantially aligned with the aperture 30. The back panel 40 is disposed a spaced distance behind the substantially flat front 25 and contains a substantially flat background display 50 and a substantially flat foreground display 60 disposed a spaced distance in front of said background display 50.

Together, the foreground display 60 being substantially aligned with the background display 50 substantially completes the image formed by the background display such that the foreground display 60 and the background display 50 form at least one cohesive display. The cohesive display can include or incorporate a decorative scene, slogan, trademark, or other message. For example, as shown in FIGS. 1 and 2, the foreground display 60 depicts two deer standing against a background of trees and a snowy backdrop. The shadows of the deer begin in the foreground display 60 and continue in the background display 50. The background display 50 also depicts trees along a snowy backdrop, and the trees and snowy backdrop substantially align with the trees and snowy backdrop depicted in the foreground display 60 such that the foreground display 60 and background display 50 form a complete and visually enhanced decorative scene. The foreground display 60 and the background display 50 can be aligned precisely to match up with one another or alternatively can be offset from the background display 50 to enhance the visual impression created by the foreground display 60.

In one embodiment, the foreground display 60 and the background display 50 are substantially flat and constructed of semi-matte, semi-rigid organic material. In other embodiments, however, the foreground display 60 and/or the background display 50 may be three-dimensional or may be constructed of material of varying flexibility. In one embodiment, the foreground display 60 and the background display 50 are unembellished. In other variations, the foreground display 60 and/or the background display 50 contain or incorporate glitter, beads, sprinkles, metallic elements, fur, garland, feathers, jewels, leather, yarn, sand, or any other embellishment elements. In one embodiment, the foreground display 60 is comprised of only one object disposed at a spaced disposed in front of the background display 50. In other embodiments, the foreground display contains multiple objects disposed in front of the background display 50. Likewise, the background display 50 may be comprised on one or more decorative scenes, slogans, trademarks, or other messages.

Figure 3:
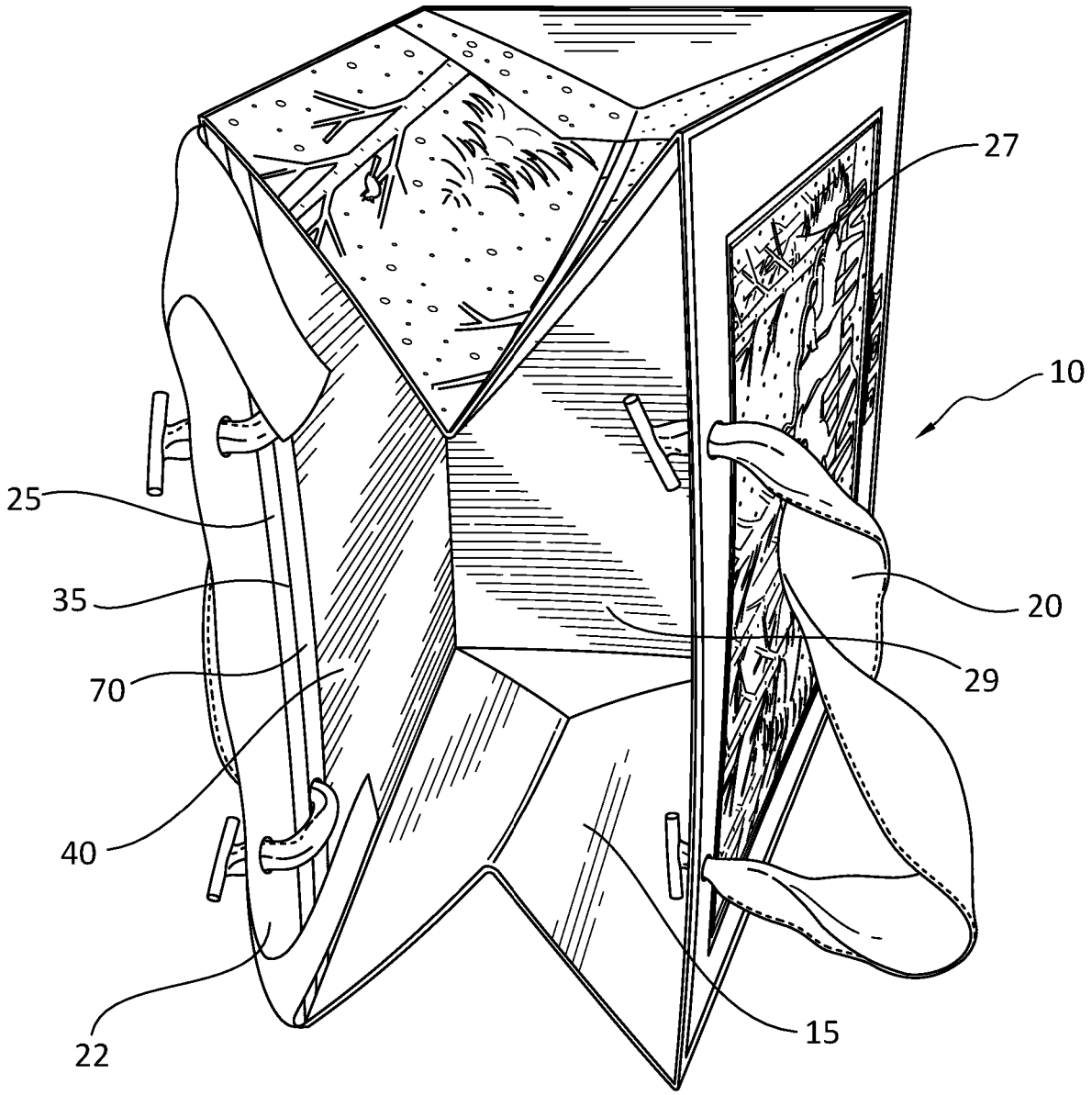
FIG. 3 is a top perspective view showing a gift bag having a three-dimensional window display and fixed three-dimensional elements.

FIG. 3 shows a top view of the bag 10. In a preferred embodiment, the recessable handles 20 can be reinforced with a foldover support 22 at the open top end 15. The back panel 40 is affixed to an intermediate back frame material 70 which, in a preferred embodiment, is formed of a 3 mm ethylene-vinyl acetate foam sheet or a recycled or biodegradable material substitute. In another embodiment, the intermediate back frame material 70 is formed of any type of foam providing stand-off. The back panel 40 and the intermediate back frame material 70 are affixed to edges of the back of the window display sheet 35 such that the back panel 40, the background display 50, and the foreground display 60 are substantially aligned with the aperture 30. Similarly, the foreground display 60 can be affixed to an intermediate material that is then affixed to the back panel 40.

Although specific example embodiments have been illustrated and described herein, those of ordinary skill in the art appreciate that other variations, aspects, or embodiments may be contemplated, and/or practiced without departing from the scope or the spirit of the appended claims.

The invention claimed is:

1. A gift bag having a three-dimensional window display comprising at least one substantially flat front;

said substantially flat front having an aperture;

a window display sheet substantially aligned with said aperture, wherein said window display sheet is substantially flat;

and a back panel affixed to an intermediate foam that is affixed to said window display sheet, said back panel having at least a front side and a back side, said back panel substantially aligned with said aperture, said back panel disposed a select spaced distance behind said substantially flat front, and said back panel comprising a background display and a foreground display, said foreground display fixedly attached to said background display on the front side of said back panel, said foreground display disposed a spaced distance less than the select spaced distance in front of said background display, and said foreground display and said background display forming at least one cohesive display.

2. The gift bag according to claim 1 wherein said aperture is substantially rectangular.

3. The gift bag according to claim 1 wherein said aperture is substantially circular.

4. The gift bag according to claim 1 wherein said window display sheet is a plastic film.

5. The gift bag according to claim 1 wherein said window display sheet is substantially transparent.

6. The gift bag according to claim 1 wherein said window display sheet is colored.

7. The gift bag according to claim 1 wherein said foreground display is substantially flat.

8. The gift bag according to claim 1 wherein said foreground display is three dimensional.

9. The gift bag according to claim 1 wherein said background display is three-dimensional and fixedly attached to said back panel.

10. The gift bag according to claim 1, wherein the intermediate foam is ethylene-vinyl acetate foam.

11. The gift bag according to claim 1, wherein the three-dimensional window display is a container which is capable of being filled with a substance, said container comprising said substantially flat front, said aperture, said window display sheet, said back panel, said back panel further comprising a top side, a bottom side, a left side, and a right side, wherein edges of said top side, said bottom side, said left side, and said right side are fixedly attached to a back of the window display sheet.

* * * * *